United States Patent [19]

Risko

[11] 4,058,813

[45] Nov. 15, 1977

[54] SHEET METAL WAVEGUIDE HORN ANTENNA

[75] Inventor: John Joseph Risko, Cranbury, N.J.

[73] Assignee: RCA Corporation, New York, N.Y.

[21] Appl. No.: 667,948

[22] Filed: Mar. 18, 1976

[51] Int. Cl.[2] ..... H01Q 13/02

[52] U.S. Cl. ..... 343/786; 29/600

[58] Field of Search ..... 343/775, 786, 780; 29/600

[56] References Cited

U.S. PATENT DOCUMENTS

| | | | |
|---|---|---|---|
| 2,467,578 | 4/1949 | Barrow | 343/786 |
| 2,638,546 | 5/1953 | Chu et al. | 343/786 |
| 2,996,790 | 8/1961 | Trafford | 29/600 |
| 3,530,482 | 9/1970 | Palmer | 343/786 |

*Primary Examiner*—Eli Lieberman

*Attorney, Agent, or Firm*—Robert M. Rodrick; Joseph D. Lazar; H. Christoffersen

[57] ABSTRACT

A waveguide horn antenna for transmitting or receiving microwave energy. The antenna comprises a tapered horn portion attached to a straight waveguide portion adapted to be coupled to a source or detector of microwave energy. The walls of the antenna are made of folded sheet metal stamped according to predetermined patterns for simple assembly.

5 Claims, 15 Drawing Figures

SHEET METAL WAVEGUIDE HORN ANTENNA

BACKGROUND OF THE INVENTION

1. Field of the Invention

This invention relates to a microwave energy waveguide horn antenna having a tapered horn portion and straight waveguide portion which has walls formed of folded sheet metal.

2. Description of the Prior Art

Waveguide horn antennas are often used in transmission systems in which microwave energy is transmitted and received. Many of these transmission systems are of the stationary type in which the size and cost are not major problems. In portable transmission systems, such as hand-held television cameras, the size and cost of certain components of such systems including the waveguide horn antennas have become critically important.

Known waveguide horn antennas are relatively expensive to fabricate. A typical prior art waveguide horn antenna is shown in FIG. 1. The waveguide horn antenna, generally designated as 10, is comprised of a waveguide portion 12 having a flange 14 and a horn portion 16 having a flange 18. Flanges 14 and 18 are joined together as by screws 20 to form the horn antenna 10.

Typically, waveguide portion 12 is machined to a rectangular cross-section. However portion 12 can be formed relatively inexpensively in large quantities by extrusion techniques because of its simple, uniform geometric shape. Also, as disclosed in U.S. Pat. No. 3,925,883 isued on Dec. 16, 1975, instead of being machined or extruded, three walls of the waveguide portion 12 may be formed by bending a metallic sheet into a rectangular channel and a second metallic sheet comprising the fourth wall sealed to the channel to form the tubular rectangular waveguide. Other patents which describe methods of forming tubular structures from sheet metal are U.S. Pat. No. 2,115,441 issued on Apr. 26, 1938 and U.S. Pat. No. 2,996,790 issued on Aug. 22, 1971, neither of which discloses the present invention.

The horn portion 16, being of a tapered rectangular cross-section, is more difficult to fabricate because of its irregular form. Horn portion 16 is usually fabricated by machining or by a well-known electroforming process which consists of plating a material, such as copper, to a given thickness on a mandrel formed of another material, such as aluminum. The mandrel is shaped to provide the inner dimensions of the horn portion desired. The mandrel is subsequently etched out by a chemical solution which does not react with the plated material leaving thereby the horn structure but destroying the mandrel. This process of electroforming, which requires the use of a separate mandrel for each horn portion, is so costly as to be prohibitive for fabrication of horn antennas in a portable microwave transmission system.

SUMMARY OF THE INVENTION

According to the present invention, a waveguide horn antenna has a tapered horn portion of rectangular cross-section attached at its narrower end to a straight waveguide portion of rectangular cross-section. The waveguide horn antenna comprises a first section defining three walls of the horn portion and a second section defining three walls of the waveguide portion and the fourth wall of the horn portion. These two sections are formed of folded sheet metal. A third metallic section comprises the fourth wall of the waveguide portion. The three sections are attached by fastening means to form the waveguide horn antenna.

BRIEF DESCRIPTION OF THE DRAWING

FIG. 8(*b*) is a side elevation view of the third section shown in FIG. 8(*a*).

DETAILED DESCRIPTION OF THE PREFERRED EMBODIMENT

Figure 1:
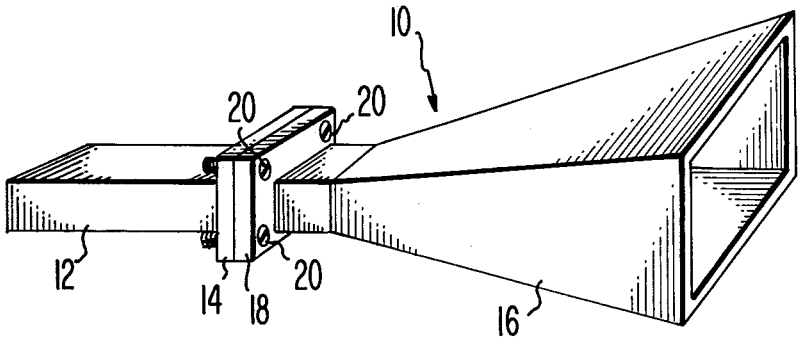
PRIOR ART Fig. 1
FIG. 1 is a perspective view of a prior art waveguide horn antenna, described in the "Description of the Prior Art" section above.
Figure 2:
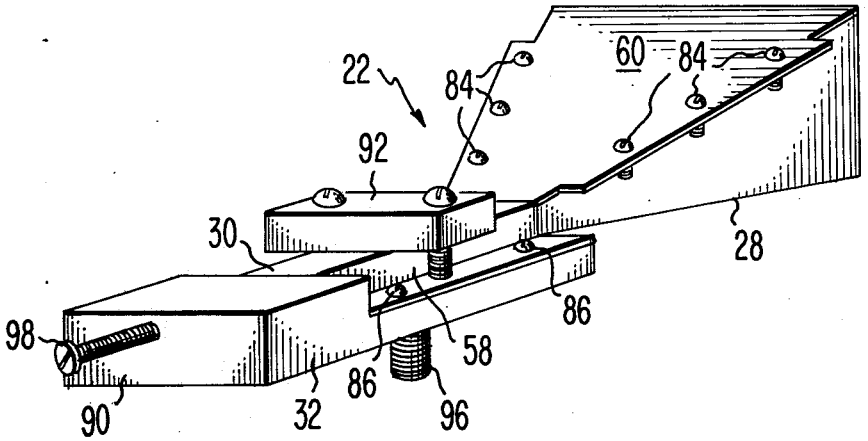
FIG. 2 is a perspective view of one embodiment of a waveguide horn antenna according to the present invention.
Figure 3:
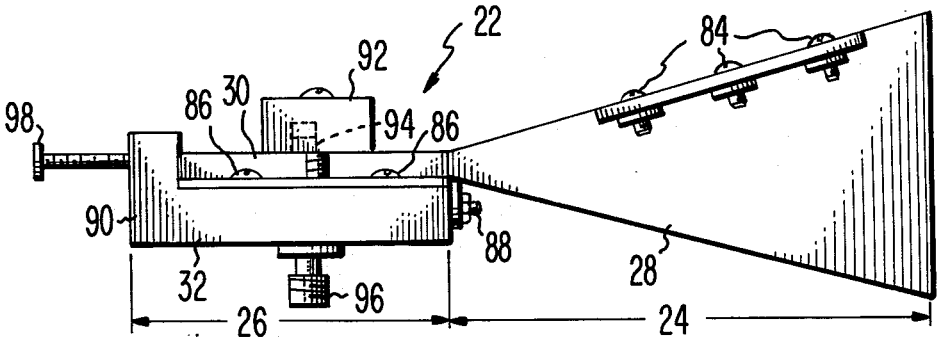
FIG. 3 is a side elevation view of the antenna shown in FIG. 2.

Referring now to FIGS. 2 and 3 of the drawing, there is shown a preferred embodiment of a waveguide horn antenna according to the invention, generally designated as 22. Waveguide horn antenna 22 has a tapered horn portion (indicated by the arrow 24) of rectangular cross-section attached at its narrower end to a straight waveguide portion (indicated by the arrow 26) of rectangular cross-section.

Figure 4:
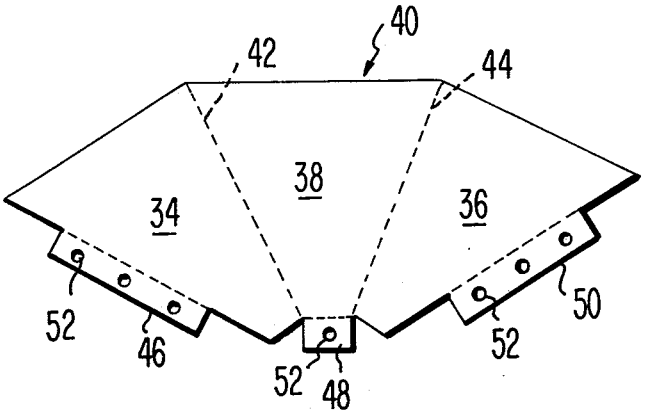
FIG. 4 is a plan view of a development of one section of sheet metal of the antenna of FIG. 2.
Figure 5:
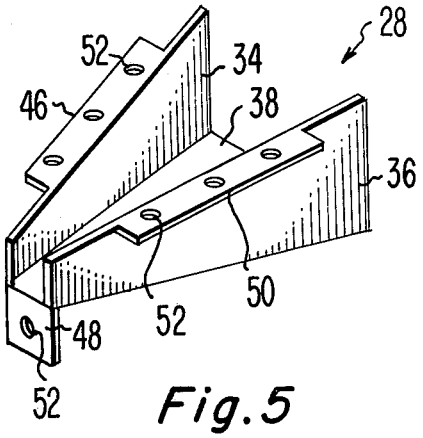
FIG. 5 is a perspective view of the development shown in FIG. 4 folded into an intermediate form of a portion of the antenna horn.
Figure 7:
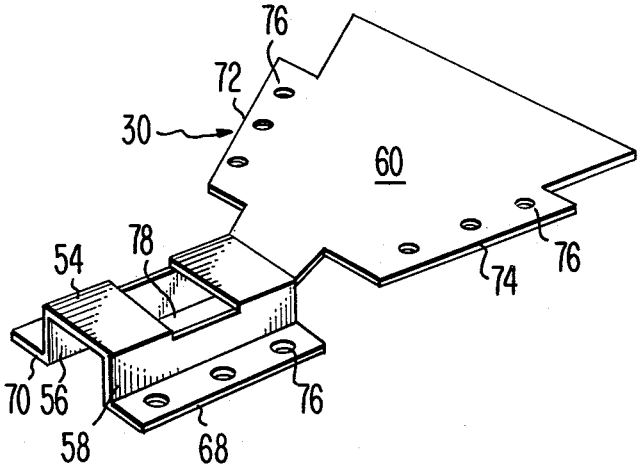
FIG. 7 is a perspective view of the development shown in FIG. 6 folded into its intermediate form.
Figure 8A:
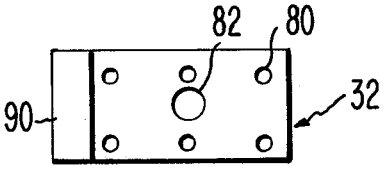
FIG. 8(*a*) is a plan view of a third section of the antenna of FIG. 2.
Figure 8B:
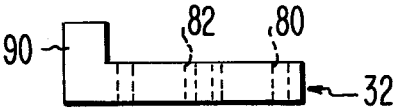

Waveguide horn antenna 22 is comprised of first section 28, second section 30 and third section 32 shown in detail in FIGS. 5, 7 and 8(*a*) and (*b*) respectively. As depicted in FIG. 5, first section 28 comprises three walls of horn portion 24, preferably the two side walls 34 and 36 and the bottom wall 38. First section 28 is formed by folding a first pattern 40 of a single sheet of metal, preferably copper, shaped as shown in FIG. 4. Pattern 40 is a development of the walls of first section 28 which is folded by suitable folding tools along fold lines 42 and 44 to provide the configuration of first section 28 as shown in FIG. 5. Fastening flanges 46, 48 and 50 having through holes 52 are preferably formed as an integral part of pattern 40 and folded as shown ot provide for assembly of the waveguide horn antenna 22, described subsequently. Pattern 40 is formed by stamping the sheet metal with an automatic punch press or other suitable stamping equipment.

Figure 6:
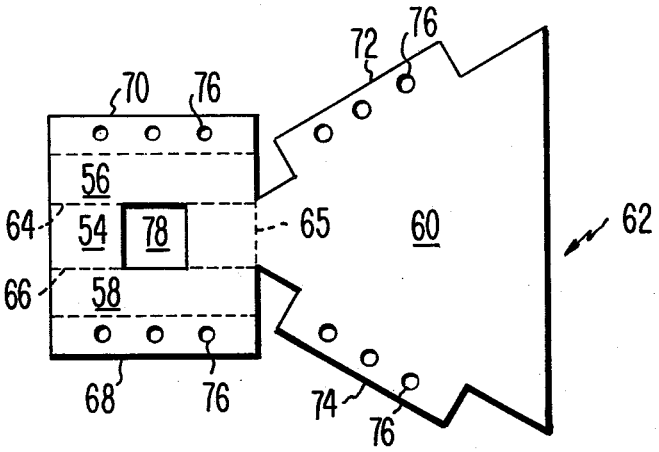
FIG. 6 is a plan view of a development of another section of sheet metal of the antenna of FIG. 2.

Second section 30 as shown in FIG. 7 comprises three walls of waveguide portion 26, preferably the top wall 54 and the two side walls 56 and 58, and the fourth wall 60 of the horn portion 24, preferably the top. Similar to first section 28, second section 30 is also formed of folded sheet metal by folding a second pattern 62 as shown in FIG. 6, pattern 62 being a development of the walls of second section 30. Pattern 62 is folded along fold lines 64, 65 and 66. Fastening flanges 68, 70, 72 and 74 having through holes 76 are also formed integrally with pattern 62 to allow for assembly of the waveguide horn antenna 22. Pattern 62 which is preferably stamped may also be provided with an aperture 78 to provide for mounting a microwave source or detector 94 (FIG. 3) into the waveguide portion 26 for transmitting or receiving microwave energy.

The third section 32 is shown in FIGS. 8(*a*) and 8(*b*). Third section 32 forms the fourth wall of waveguide portion 26, preferably the bottom, (see FIGS. 2 and 3) and is made of metal, preferably brass. Third section 32 may have threaded holes 80 to allow assembly to second section 30 and may also have through hole 82 to provide for mounting a connector 96 (FIG. 3) to apply a bias voltage to the microwave source or detector 94.

Referring now to FIGS. 2 and 3, waveguide horn antenna 22 is assembled by fastening the flanges 46 and 50 of first section 28 to the flanges 72 and 74 of second section 30 by fastening means 84 preferably screws. Other known joining devices or methods such as, for example, welding, brazing or soldering may also be used. Flanges 68 and 70 of second section 30 are attached to third section 32 by screws 86. Flange 48 of first section 28 is attached to third section 32 by a screw 88.

The open end of waveguide portion 26 remote from the end attached to horn portion 24 is closed preferably by an integral extension 90 of third section 32, although separate closing means may be used. A block 92 may be mounted to waveguide portion 26 to house a source or detector 94 for transmitting or receiving microwave energy. A bias voltage (not shown) may be applied to source or detector 94 as by connector 96. A tuning screw 98 may also be provided to permit fine adjustment of the transmitting or receiving circuits.

Contrary to the typical prior art method of forming a metallic sheet into an open-sided rectangular channel to form a straight rectangular waveguide portion, the present invention contemplates forming one (60) of the walls of the horn portion (24) as an integral extended part of the section (30) comprising three walls of the straight waveguide portion (26).

Figure 9:
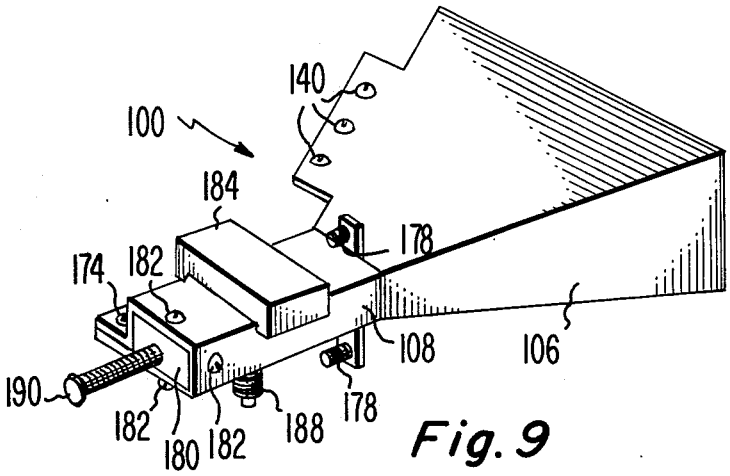
FIG. 9 is a perspective view of another embodiment of a waveguide horn antenna according to the present invention.
Figure 10:
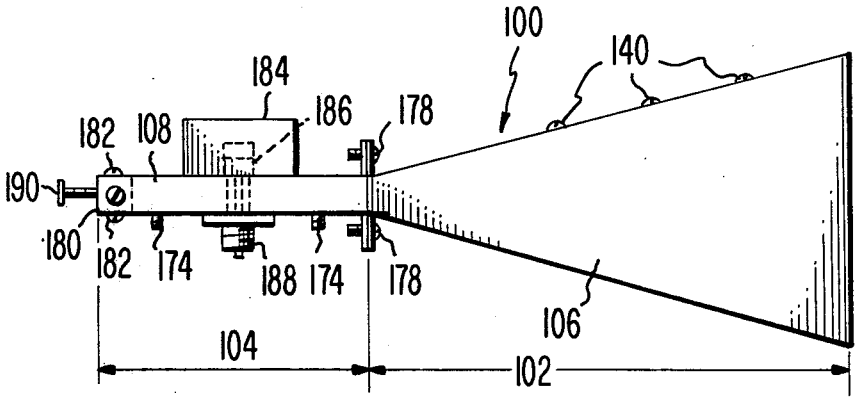
FIG. 10 is a side elevation view of the embodiment shown in FIG. 9.

In FIGS. 9 and 10 of the drawing there is shown another embodiment of the invention, generally designated as 100. Waveguide horn antenna 100 comprises a tapered horn portion (indicated by the arrow 102) of rectangular cross-section attached at its narrower end to a straight waveguide portion (indicated by the arrow 104) of rectangular cross-section.

Figure 11:
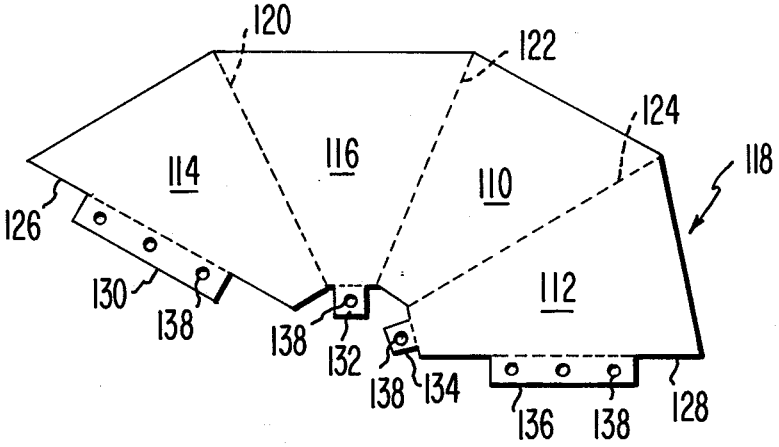
FIG. 11 is a plan view of a development of one section of sheet metal of the embodiment of FIG. 9.
Figure 12:
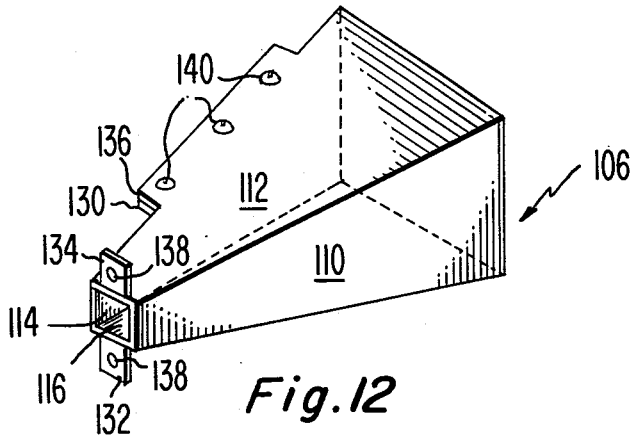
FIG. 12 is a perspective view of the development shown in FIG. 11 folded into an intermediate horn portion.
Figure 14:
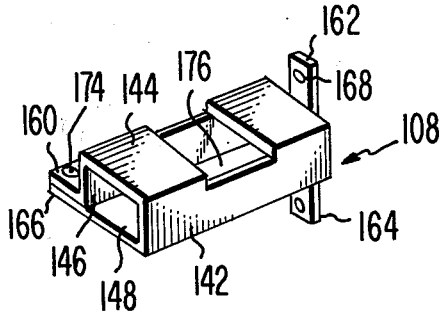
FIG. 14 is a perspective view of the development shown in FIG. 13 in folded form.

Waveguide horn antenna 100 is formed of first section 106 and second section 108, shown in detail in FIGS. 12 and 14. As depicted in FIG. 12, first section 106 of horn portion 102 comprises four walls 110, 112, 114, and 116. First section 106 is formed by folding a first pattern 118 of sheet metal, preferably copper, as shown in FIG. 11. Pattern 118 is a development of the walls of first section 106 which is folded by suitable folding tools along fold lines 120, 122, and 124 such that the free edges 126 and 128 respectively are in substantial alignment. Flanges 130, 132, 134, and 136 having through holes 138 may also be formed as an integral part of pattern 118 and folded to allow for assembly of the waveguide horn antenna 100. Horn portion 102 may be assembled by attaching flanges 130 and 136 on free edges 126 and 128 respectively as by screws 140, shown in FIG. 12 although other joining methods may also be used. Pattern 118 is made by a stamping process.

Figure 13:
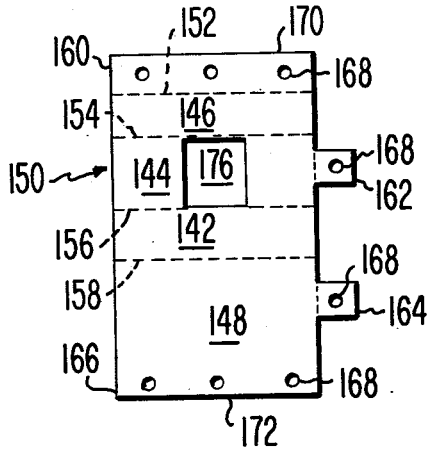
FIG. 13 is a plan view of a development of another section of sheet metal of the embodiment of FIG. 9.

Second section 108 as shown in FIG. 14 comprises four walls 142, 144, 146 and 48 of the straight waveguide portion 104. Similar to first section 106, second section 108 is also formed of folded sheet metal by folding a second pattern 150 as shown in FIG. 13. Second pattern 150 is a development of the walls of second section 108, folded along fold lines 152, 154, 156, and 158. Flanges 160, 162, 164 and 166 having through holes 168 may also be formed as an integral part of pattern 150, the free edges 170 and 172 of flanges 160 and 166 respectively being in substantial alignment upon the folding of pattern 150. Waveguide portion 104 may be assembled by attaching flanges 160 and 166 as by screws 174, as shown in FIG. 14. Pattern 150 which may be stamped may also be provided with an aperture 176 to allow for mounting a microwave source or detector 186 (FIG. 10) into the waveguide portion 104 for transmitting or receiving mircowave energy.

Referring now to FIGS. 9 and 10, waveguide horn antenna 100 is assembled by fastening the flanges 132 and 134 of first section 106 to the flanges 164 and 162 of second section 108 as by screws 178 or other joining techniques. The open end of waveguide portion 104 remote from the end attached to horn portion 102 is closed by a plug 180 which is attached to second section 108 by screws 182. A block 184 may be mounted to waveguide portion 104 to support a source or detector 186 for transmitting or receiving microwave energy. A bias voltage (not shown) may be applied to source or detector 186 as by connector 188. A tuning screw 190 may also be provided to permit fine adjustment of the transmitting or receiving circuits.

The embodiment of the invention illustrated in FIGS. 9 and 10 differs from the prior art method of making a straight waveguide portion by forming a rectangular channel sealed with a second metallic sheet in that the four walls of the waveguide portion of the present embodiment of the invention are formed from a single metallic sheet. The free ends of the folded sheet are attached to form the straight rectangular waveguide portion.

What is claimed is

1. A microwave energy waveguide horn antenna having a tapered horn portion of rectangular cross-section attached at its narrower end to a straight waveguide portion of rectangular cross-section, comprising:

a first section defining three walls of said horn portion;

a second section defining three walls of said waveguide portion and the fourth wall of said horn portion;

said first and second sections being formed of folded sheet metal;

a third metallic section defining the fourth wall of said waveguide portion; and fastening means for attaching together said first, second and third sections to form said waveguide horn antenna having an open-ended horn portion and an open-ended waveguide portion.

2. A waveguide horn antenna according to claim 1, further including means to close the open end of said waveguide portion.

3. A waveguide horn antenna according to claim 2, wherein said straight waveguide portion further includes:

a source for transmitting microwave energy; and means to couple a bias voltage to said source.

4. A waveguide horn antenna according to claim 2, wherein said straight waveguide portion further includes:

a detector for receiving microwave energy; and means to couple a bias voltage to said detector.

5. A method of making a waveguide horn antenna having a tapered horn portion of rectangular cross-section attached at its narrower end to a straight waveguide portion of rectangular cross-section, which comprises the steps of:

folding a first section of sheet metal into three walls of said horn portion;

folding a second section of sheet metal into three walls of said waveguide portion and the fourth wall of said horn portion and;

attaching by fastening means said folded first and second sections to a third section comprising the fourth wall of said waveguide portion to form said waveguide horn antenna having an open-ended horn portion and an open-ended waveguide portion.

* * * * *